US008059033B2

(12) United States Patent
Säily

(10) Patent No.: US 8,059,033 B2
(45) Date of Patent: Nov. 15, 2011

(54) PATCH ANTENNA

(75) Inventor: Jussi Säily, Espoo (FI)

(73) Assignee: Nokia Siemens Networks GmbH & Co. KG, Munich (DE)

( * ) Notice: Subject to any disclaimer, the term of this patent is extended or adjusted under 35 U.S.C. 154(b) by 421 days.

(21) Appl. No.: 12/320,067

(22) Filed: Jan. 15, 2009

(65) Prior Publication Data

US 2009/0201211 A1 Aug. 13, 2009

(30) Foreign Application Priority Data

Jan. 15, 2008 (EP) ..... 08000696

(51) Int. Cl.
*H01Q 1/24* (2006.01)

(52) U.S. Cl. ..... 343/700 MS

(58) Field of Classification Search ..... 343/700 MS, 343/702
See application file for complete search history.

(56) References Cited

U.S. PATENT DOCUMENTS 5,165,109 A * 11/1992 Han et al. ..... 343/700 MS
5,231,406 A * 7/1993 Sreenivas ..... 343/700 MS
5,576,718 A * 11/1996 Buralli et al. ..... 343/700 MS
5,896,107 A * 4/1999 Huynh ..... 343/700 MS
5,955,994 A 9/1999 Staker et al.
6,031,491 A * 2/2000 Daniel et al. ..... 343/700 MS
6,300,906 B1 * 10/2001 Rawnick et al. ..... 343/700 MS
6,407,705 B1 6/2002 Sanad
2002/0175879 A1 * 11/2002 Sabet et al. ..... 343/895

FOREIGN PATENT DOCUMENTS

EP 0154858 A 9/1985
GB 2067842 A 7/1981
JP 09246852 A 9/1997
WO WO 91/12637 A 8/1991

OTHER PUBLICATIONS

Saily J: "Proximity-coupled and dual-polarized microstrip patch antenna for WCDMA base station arrays" Proceedings of 2006 Asia Pacific Microwave Conference, Dec. 12, 2006, Dec. 12-15, 2006 (2006-12-15) pp. 628-631, XP002476331 Yokohama, Japan * the whole document*.

* cited by examiner

*Primary Examiner* — Tho G Phan
(74) *Attorney, Agent, or Firm* — Staas & Halsey LLP

(57) ABSTRACT

A patch antenna has a primary radiator, a dual microstrip feed line configured to utilize corner-feeding to enable substantially diagonal radiating modes, and at least two parasitic patches that are arranged adjacent and on opposite sides to the primary radiator.

20 Claims, 7 Drawing Sheets

PATCH ANTENNA

CROSS REFERENCE TO RELATED APPLICATIONS

This application is based on and hereby claims priority to European Application No. EP08000696 filed on Jan. 15, 2008, the contents of which are hereby incorporated by reference.

BACKGROUND OF THE INVENTION

J. Säily, "Proximity-coupled and dual-polarized microstrip patch antenna for WCDMA base station arrays", Proceedings of the 2006 Asia-Pacific Microwave Symposium, Dec. 12-15, 2006, Yokohama, Japan, shows a dual-polarized microstrip patch antenna. The antenna uses proximity-coupled microstrip feed lines along the patch corners and covers Wideband Code Division Multiple Access/Universal Mobile Telecommunications System (WCDMA/UMTS) band with only a single radiating patch. The corner-fed patch arrangement results in two orthogonal linear polarizations along the patch diagonals with high isolation. The presented antenna can be applied in dual-slant polarized base station antenna arrays.

A Wireless Local Area Network (WLAN) access antenna can be omni-directional or it may include a number of sectors having multiple antennas. A typical number of sectors is between three and six. The construction is a compromise between the cost of the antenna and the capacity and operating range. The operating range is typically limited by a low transmit power of the mobile device such as, e.g., a phone, a PDA, a laptop or the like.

A dual-polarized dipole array antenna is disclosed in U.S. Pat. No. 6,819,300 B2, "Dual-polarized dipole array antenna." Furthermore, a dual-polarized aperture-coupled patch antenna array can be provided as suggested in U.S. Pat. No. 5,923,296, "Dual polarized microstrip patch antenna array for PCS base stations." The different polarizations use separate radiating patches and result in rather large arrays.

The sector coverage of dual-polarized patch antenna arrays is typically limited to below 100 degrees. Dipole antennas can be used to reach 120 degree half-power beamwidths, but they require shaped ground planes and additional height.

An operating range of an access point is typically limited by the transmit power provided by the mobile terminal. In addition, a reception antenna needs a high gain. Usually, the gain of an antenna array is increased by vertically stacking many elements. This results in a very narrow beam in the vertical direction. The radiated beam will be fan-shaped, i.e., wide in a horizontal direction and narrow in a vertical direction. The narrow vertical coverage means that the antenna needs to be down-tilted, wherein received signal levels from outside the main beam region may be considerably smaller.

SUMMARY

One potential problem to be solved is to overcome the disadvantages as stated above and to enable an antenna in particular an antenna array with a less complex structure allowing a significantly widened beamwidth.

In order to overcome this problem, a patch antenna is provided comprising a primary radiator, a dual microstrip feed line configured to utilize corner-feeding to enable substantially diagonal radiating modes, at least two parasitic patches that are arranged adjacent and on opposite sides to the primary radiator.

The approach presented allows the design of high-performance dual- or circularly-polarized antenna arrays with wide horizontal beamwidths and large sector coverage.

The approach can be applied at a broad frequency band including RF-, micro- and millimeter waves. The resulting patch antenna arrays can be made considerably smaller than with conventional parasitic patch arrangements, because only half the number of parasitic patches is required for dual-polarized operation.

In an embodiment, several parasitic patches are arranged substantially on or in a plane on opposite sides of the primary radiator.

In particular, two parasitic patches are arranged adjacent to the primary radiator, wherein the two parasitic patches are substantially equally spaced from the primary radiator and located on opposed sides of said primary radiator.

In another embodiment, the primary radiator and the at least two parasitic patches are of substantially rectangular shape, in particular of substantially quadratic shape.

However, the primary radiator and the parasitic patches may be of different shapes as well, even of non-symmetrical shapes. In particular, the shapes of the primary radiator and of the parasitic patches may show a certain degree of similarity.

In a further embodiment, the at least two parasitic patches are arranged in parallel to the edges of the primary radiator.

In a next embodiment, the at least two parasitic patches are smaller or of substantially the same size as the primary radiator.

It is also an embodiment that each two of the at least two parasitic patches that are arranged on opposite sides of the primary radiator are of substantially the same shape and/or size.

Pursuant to another embodiment, the primary radiator and the parasitic patches are substantially within one plane and/or arranged on or in a layer.

Also, the primary radiator and/or the parasitic patches are of the same (base) material.

According to yet an embodiment, the at least two parasitic patches are offset in a vertical or in a horizontal direction from a center axis of the primary radiator.

According to a further embodiment, the at least two parasitic patches are offset in the same direction or in opposite directions.

According to an embodiment, a beamwidth of the antenna is modified by modifying a separation between the parasitic patch and the primary radiator.

In order to widen the beamwidth by using parasitic patches the patch separation is chosen to be so that the currents in the primary radiator and the induced currents in the parasitics are in opposite phase at some operating frequency, preferably at a mid-band frequency (range).

According to another embodiment, the antenna comprises a dual-polarized microstrip patch antenna.

In yet another embodiment, the antenna comprises a proximity-coupled microstrip patch antenna.

According to a next embodiment, the antenna comprises an aperture-coupled, a slot-coupled, and/or a probe-fed patch antenna.

However, other known coupling techniques are as well possible to excite the primary radiating patch.

The problem stated above is also solved by an array of antennas comprising at least one antenna as described herein.

In addition, the problem stated above is solved by an access point comprising and/or associated with at least one antenna as described herein. The access point may in particular be a wireless local area network access point.

Also, the problem stated above is solved by a base station comprising and/or associated with at least one antenna as described herein. The base station may in particular be a cellular communication base station.

Further, the problem stated above is solved by a mobile terminal, in particular a cell phone, comprising and/or associated with at least one antenna as described herein.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
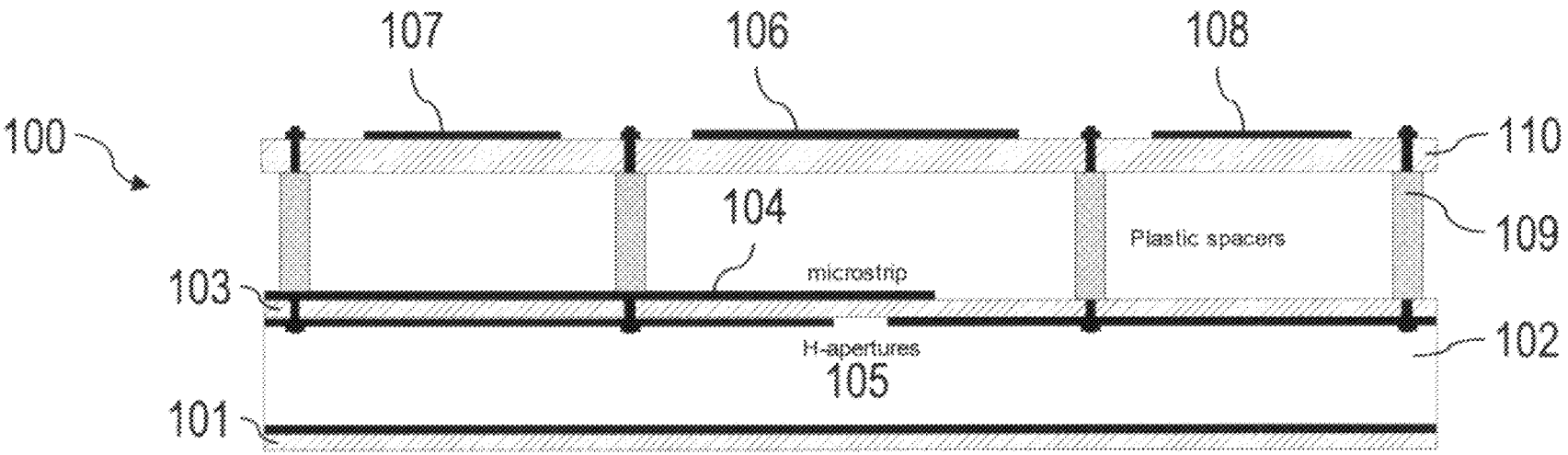
FIG. 1 shows a sectional view or layer diagram of a patch antenna comprising a primary radiator and two parasitic patches.

Reference will now be made in detail to the preferred embodiments of the present invention, examples of which are illustrated in the accompanying drawings, wherein like reference numerals refer to like elements throughout.

The approach described herein in particular enables an application of parasitic patches to a dual-polarized microstrip patch antenna using corner-feeding and thus diagonal radiating modes.

Hence, preferably only two parasitic patches are needed for shaping the beamwidths of both polarizations at the same time.

Parasitic patches can advantageously be excited by the diagonal radiating modes, although coupling may be not as direct compared to traditional E- and H-plane coupling. Therefore, the parasitic patches can be quite close to the main radiator, and may be, e.g., almost the same size as said main radiator.

A resulting beamwidth and a main beam ripple may be controlled or adjusted by, e.g., reducing or increasing a parasitic patch size and/or a distance of the parasitic patch from the primary radiator.

In order to widen the beamwidth by using parasitic patches the patch separation is chosen to be so that the currents in the primary radiator and the induced currents in the parasitics are in opposite phase at some operating frequency, preferably at a mid-band frequency (range).

A far-field radiation pattern from such a current distribution has a certain main beam ripple which can be controlled by the coupling, i.e., a size and a location of the parasitic patch(es). A smaller patch has lower coupling factor and less main beam ripple for the same patch separation distance.

Advantageously, the beam shapes and the beamwidths with both polarizations may be highly symmetrical with the approach suggested, which is advantageous for obtaining a maximum diversity gain, in particular near sector edges.

The approach provided is suitable for, e.g., proximity-coupled microstrip patch antennas or aperture-coupled, slot-coupled or probe-fed patch antennas.

A sectional view of an exemplary design of a patch antenna 100 is shown in FIG. 1. This antenna 100 is frequency scaled to a 2.4 GHz WLAN frequency range and optimized for low-cost FR-4 substrate.

The antenna 100 comprises a reflecting ground plane 101 above which a feed plane 103 is located. Between the ground plane 101 and the feed plane 103 is an air gap 102.

Alternatively, instead of air a foam or other low loss dielectric may be utilized between said planes.

The feed plane 103 comprises on its side that points towards the ground plane 101 H-apertures 105 (see also FIG. 2) and on its opposed side the feed plane 103 comprises a microstrip feed line 104.

The feed plane 103 is spaced by plastic spacers 109 from a radiating plane 110. The spacers 109 may in particular build an air gap between the feed plane 103 and the radiating plane. Alternatively, instead of air a foam or other low loss dielectric may be utilized between said planes.

A primary radiator 106 is arranged above the middle of an H-aperture 105 and parasitic patches 107 and 108 are arranged lateral to the primary radiator. The primary radiator 106 and the parasitic patches 107 and 108 are arranged on (or in) the same radiating plane 110.

The reflecting ground plane 101 is optional and may be omitted.

The examples set forth are in particular directed to two antenna elements with different half-power beamwidth (HPBWs), i.e. 120 degrees and 90 degrees. Such HPBWs may preferably used in WLAN antenna arrays.

Figure 2:
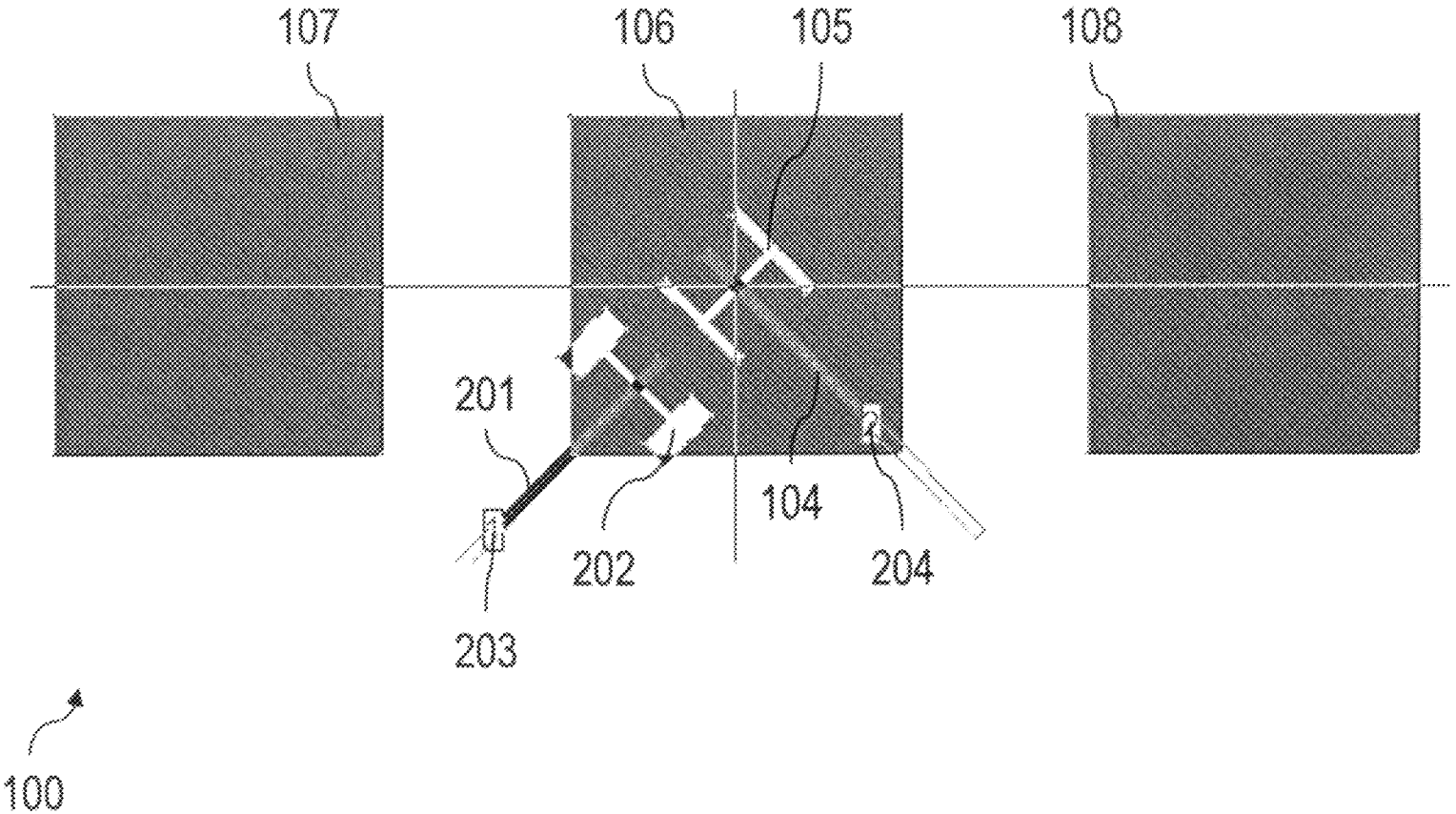
FIG. 2 shows a top view of a 120 degree sector patch antenna comprising two H-shaped apertures and two microstrip corner feed lines.
Figure 3:
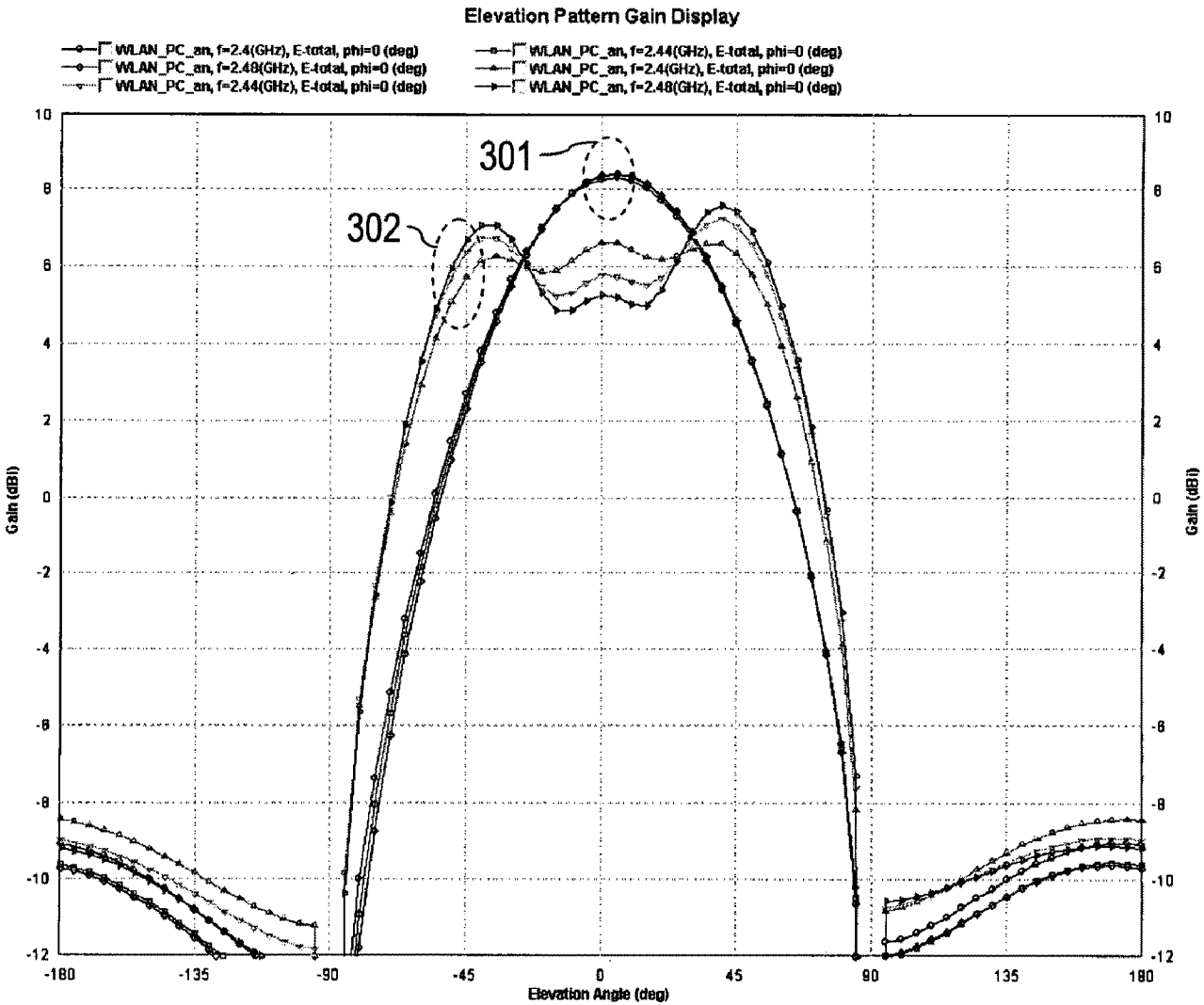
FIG. 3 shows radiation patterns of the patch antenna according to FIG. 2.

The 120 degree antenna and its radiation patterns from one port are shown in FIG. 2 and in FIG. 3, respectively.

In a proximity-coupled antenna, the microstrip feed line 104 excites the primary radiating patch 106 with the help of a specially shaped slot 105 (H-aperture) in the ground plane.

A top view to the patch antenna 100 is depicted in FIG. 2 comprising the primary radiator 106 and the parasitic patches 107 and 108. Below the main radiator 106 a corner fed microstrip feed line 201 is provided as well as the corner fed microstrip feed line 104 is shown. The microstrip feed line 201 is located above an H-aperture 202 and the microstrip feed line 104 is located above the H-aperture 105 as shown in FIG. 1.

In FIG. 2, dual-linear or circular polarizations can be used depending on port connections.

The microstrip feed lines are located along the patch diagonals so that they couple to higher order modes TM01 and TM10 simultaneously. FIG. 2 shows that in the simulation model a Port 1 203 is located near the left corner of the primary radiator 106 and a Port 2 204 is near the right corner of the primary radiator 106. In a practical implementation, the microstrip feed lines may extend farther away from the primary radiator and connect to a feed network.

The "T-configuration" between the microstrip feed line 201 and the H-aperture 202 as well as between the microstrip feed line 104 and the H-aperture 105 allows a high isolation between the resulting polarizations.

The size of the H-aperture 105 is considerably smaller due to a higher coupling factor in the patch center than the size of the H-aperture 202 located near the patch corner.

The shown structure may in particular use 0.8 mm thick FR-4 feed substrate and a 1.6 mm thick radiator substrate. The width of the antenna element including the parasitic patches and substrate may amount to ca. 200 mm. A height of the antenna including the substrates may amount to ca. 9 mm.

In FIG. 3, a group of graphs 301 show horizontal radiation patterns from Port 1 for the primary radiator 106 without parasitic patches (narrow beam) and a group of graphs 302 show horizontal radiation patterns from Port 1 for the primary radiator 106 with parasitic elements (wide beam with ripple). Both groups of graphs 301 and 302 are shown for a frequency range from 2.40 GHz to 2.48 GHz in view of a gain.

The horizontal beamwidth with parasitic patches (i.e. group of graphs 302) is about 120 degrees at mid-band. The beamwidth of the primary radiator only (i.e. group of graphs 301) amounts to ca. 72 degrees.

The results from Port 2 are similar: The vertical radiation patterns are almost identical to the horizontal pattern of the primary element 301 due to symmetry (vertical and horizontal cuts of a diagonal polarization are symmetrical).

Figure 4:
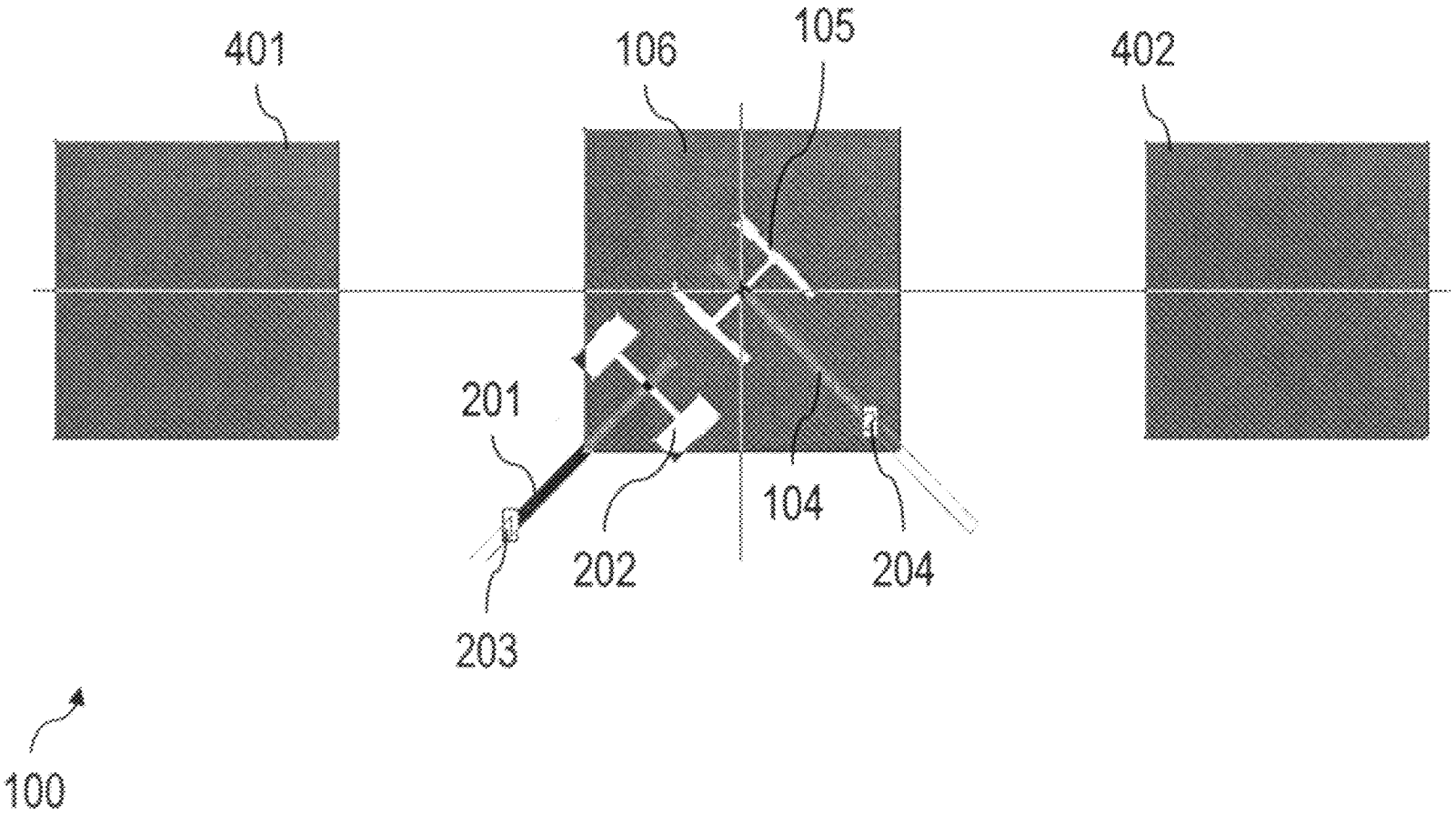
FIG. 4 shows a top view of a 90 degree sector patch antenna comprising two H-shaped apertures and two microstrip corner feed lines.

FIG. 4 shows another exemplary top view for a patch antenna with diagonal patch modes. Compared to FIG. 2, the parasitic patches 401 and 402 are slightly smaller than the parasitic patches 107 and 108 in order to reduce the coupling as well as an effect of parasitics. The remaining numerals are explained in the context of FIG. 2 above.

In FIG. 4, dual-linear or circular polarizations can be used depending on port connections.

According to FIG. 4, a patch antenna can be provided with a 90 degree horizontal beamwidth. The construction and height corresponds to the 120 degree case described above. The parasitic patches 401 and 402 are smaller and located farther away from the primary radiator 106 in order to achieve a reduced coupling.

The width of the element remains almost the same and will fit into 200 mm with substrates. It is thus possible to make a selection of different antenna beamwidths by just changing the patch substrate while the feed substrate remains the same.

Figure 5:
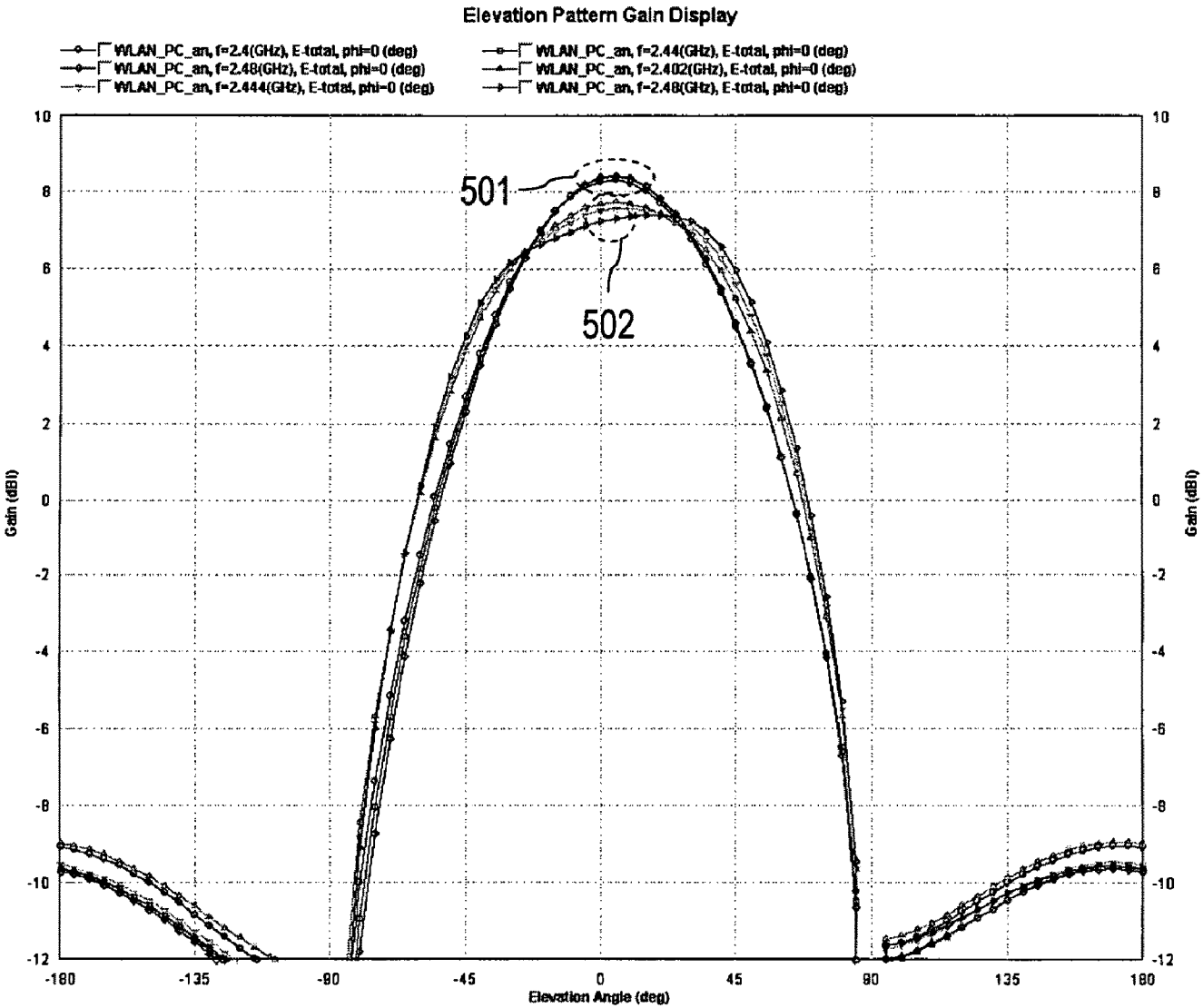
FIG. 5 shows radiation patterns of the patch antenna according to FIG. 4.

In FIG. 5, a group of graphs 501 show horizontal radiation patterns from Port 1 for the primary radiator 106 without parasitic patches (narrow beam) and a group of graphs 502 show horizontal radiation patterns from Port 1 for the primary radiator 106 with parasitic elements 401 and 402 (wide beam with ripple). Advantageously, the beamwidth with parasitic patches 401 and 402 is close to 90 degrees at mid-band frequency.

Both groups of graphs 501 and 502 are shown for a frequency range from 2.40 GHz to 2.48 GHz in view of a gain.

The dual-polarized antenna can be used also for circular polarization (CP). In such case, the two microstrip feed lines 104 and 201 are fed with the same type of signal but with a 90 degree phase shift between the signals. Such phase shift may be provided by, e.g., a hybrid or a transmission line phase shifter.

Figure 6:
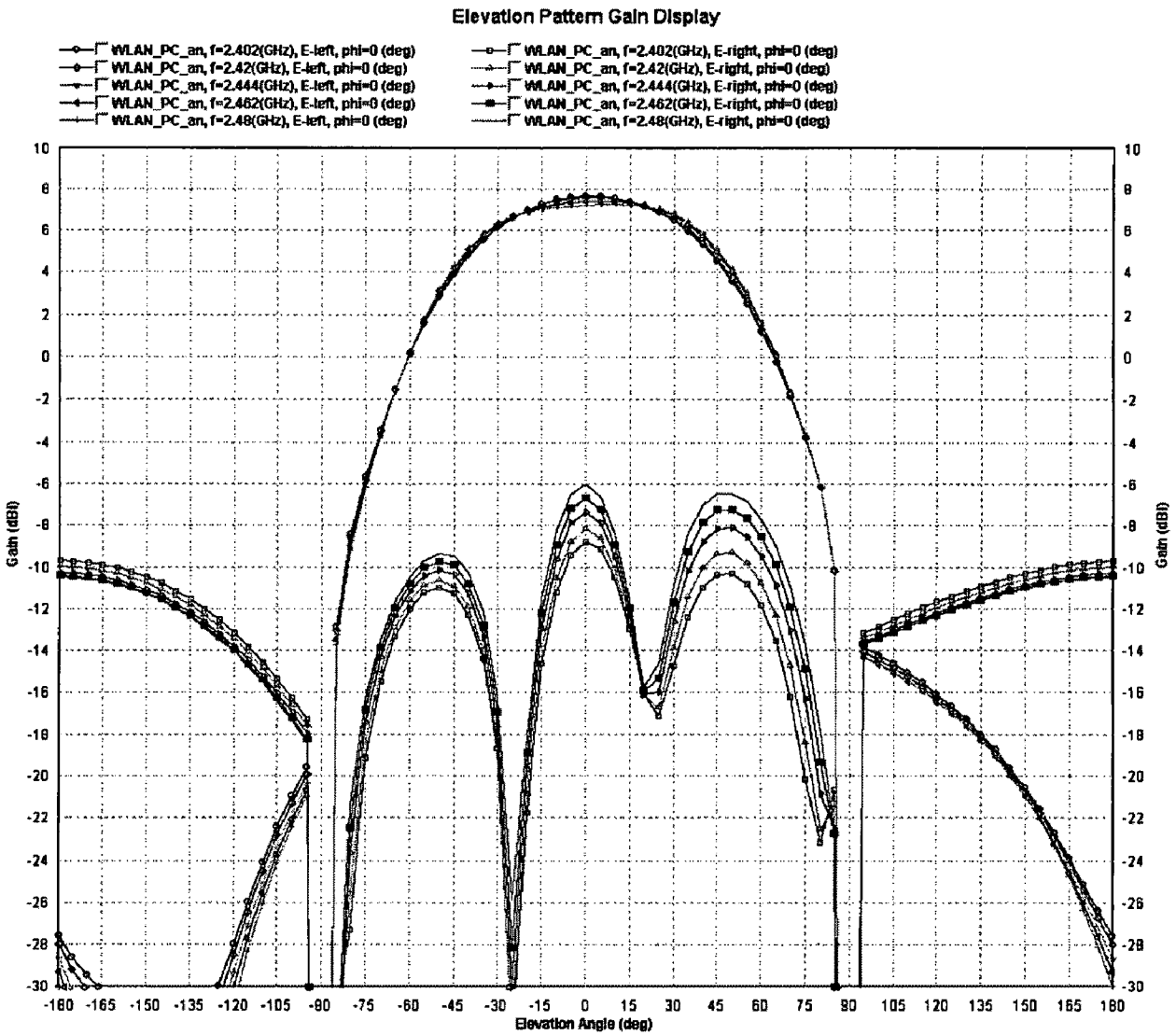
FIG. 6 shows radiation patterns of a 90 degree patch antenna comprising a single radiator utilizing circular polarization.

The 90 degree antenna provides excellent results with Port 1 203 being in-phase and with Port 2 204 comprising a quadrature phase (90 degree phase difference to Port 1). A co-polar (left-handed CP) and a cross-polar (right-handed CP) radiation pattern of the 90 degree element are shown in FIG. 6. The horizontal beamwidth in co-polar patterns is close to 90 degrees. The cross-polar level is about −14 dB.

Figure 7:
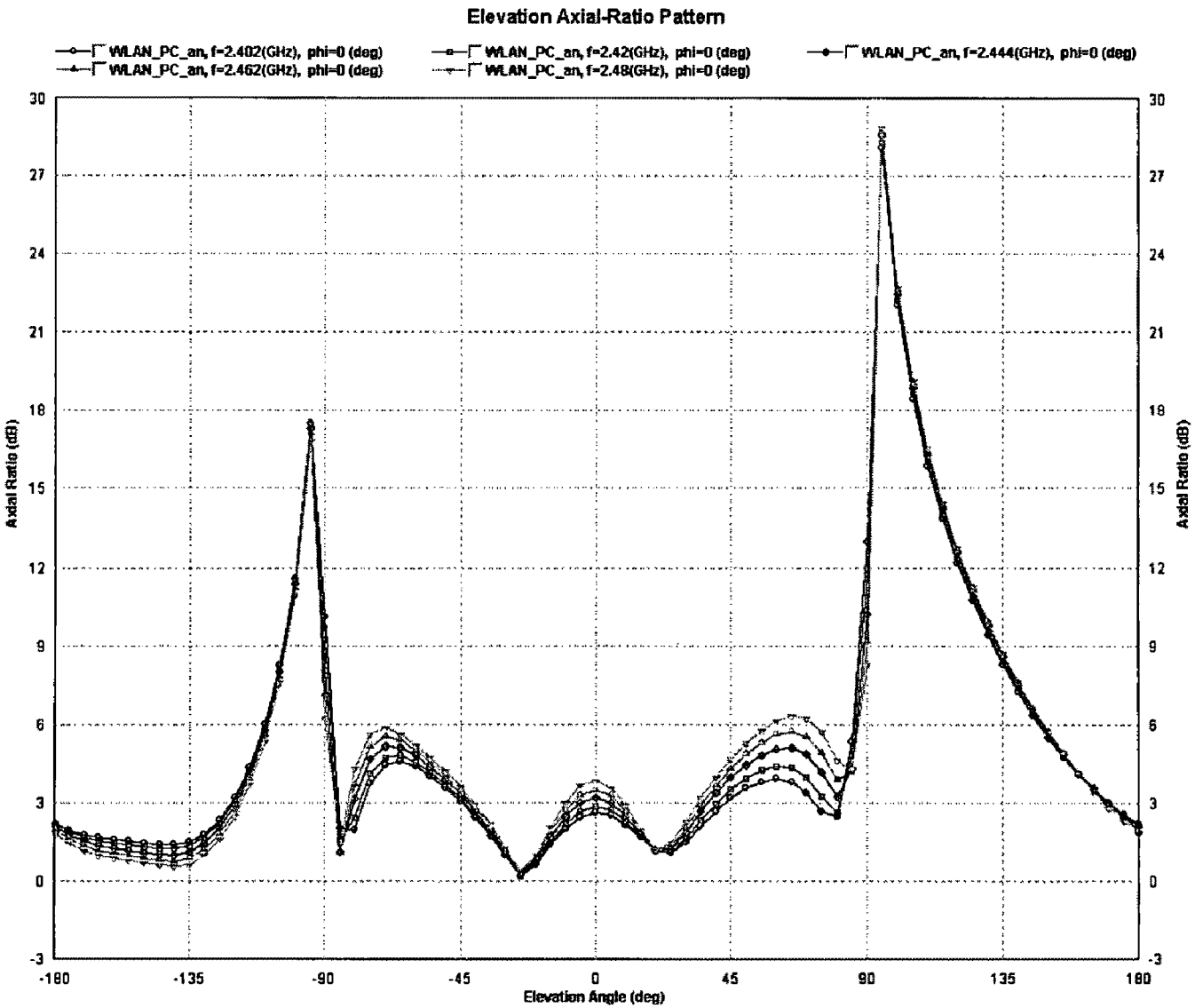
FIG. 7 shows an axial ratio of a 90 degree patch antenna comprising a single radiator utilizing circular polarization.

An axial ratio of a single radiator (90 degree type) using circular polarization is shown in FIG. 7. Said axial ratio remains between 0 and −6 dB over −90 . . . 90 degree angular range.

Further Advantages:

The approach provided allows a simplified and more efficient antenna array structure, as only one set of parasitic patches is required for widening the beamwidth by using diagonal patch modes.

Further, the approach facilitates a construction of dual-slant polarized antenna arrays with wide half-power beamwidths like 90 and 120 degrees. Also, circularly-polarized arrays with wide beamwidths are feasible.

In contrast, a typical arrangement using basic patch modes would require one set of patches for both polarizations. Further, construction of an array using four parasitic patches per element for slanted polarizations would be almost impossible.

The approach presented allows the design of high-performance dual- or circularly-polarized antenna arrays with wide horizontal beamwidths and large sector coverage. The approach can be applied at a broad frequency band including RF-, micro- and millimeter waves. The resulting patch antenna arrays can be made considerably smaller than with conventional parasitic patch arrangements because only half the number of parasitic patches is required.

In a WLAN application, the proposed dual-polarized patch technique also improves the overall link budget and reception at the sector edges when maximum ratio combining is used in the RF chipset.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV*, 69 USPQ2d 1865 (Fed. Cir. 2004).

The invention claimed is:

1. A patch antenna, comprising:

a primary radiator;

a dual microstrip feed line disposed below the primary radiator and configured to utilize corner-feeding to enable substantially diagonal radiating modes of the antenna; and at least two parasitic patches arranged adjacent to and on opposite sides of the primary radiator such that the parasitic patches increase sector coverage.

2. The antenna according to claim 1, wherein the at least two parasitic patches are arranged substantially on or in a plane on opposite sides of the primary radiator.

3. The antenna according to claim 1, wherein the primary radiator and the at least two parasitic patches are of substantially rectangular shape.

4. The antenna according to claim 3, wherein the primary radiator and the at least two parasitic patches are of substantially quadratic shape.

5. The antenna according to claim 1, wherein the at least two parasitic patches are arranged in parallel with respect to edges of the primary radiator.

6. The antenna according to claim 1, wherein the at least two parasitic patches are smaller than or of a same size as the primary radiator.

7. The antenna according to claim 1, wherein each of the at least two parasitic patches that are arranged on opposite sides of the primary radiator are of substantially similar shape and/or size.

8. The antenna according to claim 1, wherein the primary radiator and the at least two parasitic patches are substantially within one plane and/or arranged on or in a layer.

9. The antenna according to claim 1, wherein the at least two parasitic patches are offset in a vertical or in a horizontal direction from a center axis of the primary radiator.

10. The antenna according to claim 9, wherein the at least two parasitic patches are offset in a same direction or in opposite directions.

11. The antenna according to claim 1, wherein a beamwidth of the antenna is modified by modifying a separation between each of the at least two parasitic patches and the primary radiator.

12. The antenna according to claim 1, wherein the antenna is a dual-polarized microstrip patch antenna.

13. The antenna according to claim 1, wherein the antenna is a proximity-coupled microstrip patch antenna.

14. The antenna according to claim 1, wherein the antenna is an aperture-coupled patch antenna, a slot-coupled patch antenna and/or a probe-fed patch antenna.

15. A base station, comprising:

at least one patch antenna according to claim 1; and a base station transceiver connected to the at least one patch antenna.

16. The base station according to claim 15, wherein said base station is a cellular communication base station.

17. A mobile terminal, comprising:

at least one patch antenna according to claim 1; and a mobile terminal transceiver connected to the at least one patch antenna.

18. An array of antennas, comprising:

at least two patch antennas, each patch antenna including a primary radiator, a dual microstrip feed line disposed below the primary radiator and configured to utilize corner-feeding to enable substantially diagonal radiating modes of the antenna, and at least two parasitic patches arranged adjacent to and on opposite sides of the primary radiator such that the parasitic patches increase sector coverage.

19. An access point, comprising:

at least one patch antenna including a primary radiator, a dual microstrip feed line disposed below the primary radiator and configured to utilize corner-feeding to enable substantially diagonal radiating modes of the antenna, and at least two parasitic patches arranged adjacent to and on opposite sides of the primary radiator such that the parasitic patches increase sector coverage.

20. The access point according to claim 19, wherein said access point is a wireless local area network access point.

* * * * *